US007290626B2

(12) United States Patent
Terlet et al.

(10) Patent No.: US 7,290,626 B2
(45) Date of Patent: Nov. 6, 2007

(54) TRANSMISSION SLEEVE

(75) Inventors: Christopher John Terlet, Jandakot (AU); Fredric Graham Moir, Glenelg (AU); Malcolm Bicknell McInnes, Fullarton (AU); Anthony Joseph Alexander DeBarro, Jane Brook (AU)

(73) Assignee: SDS Digger Tools Pty Ltd, Canning Vale (AU)

( * ) Notice: Subject to any disclaimer, the term of this patent is extended or adjusted under 35 U.S.C. 154(b) by 165 days.

(21) Appl. No.: 10/495,445

(22) PCT Filed: Oct. 30, 2002

(86) PCT No.: PCT/AU02/01465

§ 371 (c)(1),
(2), (4) Date: Feb. 17, 2005

(87) PCT Pub. No.: WO03/042492

PCT Pub. Date: May 22, 2003

(65) Prior Publication Data

US 2005/0199429 A1 Sep. 15, 2005

(30) Foreign Application Priority Data

Nov. 13, 2001 (AU) ..... PR8799

(51) Int. Cl.
*E21B 4/14* (2006.01)

(52) U.S. Cl. ..... 175/296; 175/393; 175/417

(58) Field of Classification Search ..... 175/296, 175/417, 393

See application file for complete search history.

(56) References Cited

U.S. PATENT DOCUMENTS

| | | | |
|---|---|---|---|
| 5,154,244 | A | 10/1992 | Elsby et al. |
| 6,035,953 | A | 3/2000 | Rear |
| 6,095,261 | A | 8/2000 | Trevino, Jr. |

FOREIGN PATENT DOCUMENTS

| | | |
|---|---|---|
| AU | 656724 | 4/1990 |

(Continued)

*Primary Examiner*—David Bagnell
*Assistant Examiner*—Giovanna M Collins
(74) *Attorney, Agent, or Firm*—Thelen Reid Brown Raysman & Steiner

(57) ABSTRACT

The invention is a transmission sleeve for the reverse circulation down hole hammer activated by fluid under pressure, the hammer including an outer hammer casing, a drill bit retaining means (17) and a drill bit (10) retaining means (17) and extending forwardly therefrom. The transmission sleeve (25) comprises a transmission sleeve retaining means to retain the transmission sleeve (25) to the hammer, a flange (28) to direct exhaust fluid from the hammer extending from the transmission sleeve retaining means towards the cutting face (14) of the drill bit (10) so that the exhaust fluid is directed towards the cutting face (14) and a chamber (30) that extends circumferentially around the drill bit (10) into which the exhaust fluid flows prior to discharge from the end of the flange (28). The chamber (30) makes it possible for air pressure to be equalized around the periphery of the drill bit (10) and allows for some air flow from the end of the flange (28) between the channels (31) in the drill bit (10) to provide a curtain of air flow from the flange (28).

10 Claims, 5 Drawing Sheets

FOREIGN PATENT DOCUMENTS

| | | | |
|---|---|---|---|
| AU | 638571/01 | B | 1/1993 |
| AU | 42762/97 | B2 | 4/1998 |
| AU | 54362/01 | A1 | 1/2002 |
| GB | 2296731 | A | 10/1996 |
| WO | WO 91/16521 | A1 | 10/1991 |
| WO | WO 98/54433 | A1 | 12/1998 |
| WO | WO 01/21930 | A1 | 3/2001 |

TRANSMISSION SLEEVE

The present invention relates to an improved transmission sleeve for a reverse circulation down hole hammer and will include sacrificial transmission sleeves. It also relates to drill bit design.

Reference to reverse circulation down hole hammers will include all types of hammers using any type of fluid where exhaust fluid from the hammer is directed across the cutting face of the drill bit to entrain cuttings which are then returned to the surface through at least the drill bit and hammer.

BACKGROUND OF THE INVENTION

A well known form of reverse circulation drilling uses a percussive type air operated hammer where high pressure air is used to operate the hammer and exhaust air is used to clear the cuttings as described above.

A transmission sleeve is described in an earlier Australian Patent No. 638571. That specification describes a sacrificial transmission sleeve that is used to form a seal and also to direct exhaust air to the cutting face to assist in the clearance of chips. The invention described in the specification was an important development in reverse circulation hammers and is now commonly used in the drilling industry. Another relevant patent is Australian Patent No. 656724.

The present invention relates to improvements to the transmission sleeve. These improvements relate both to the air direction provided by the transmission sleeve and to the design of the drill bit. The sealing requirement of the improved transmission sleeve is preferred in relation to air operated reverse circulation hammers. The transmission sleeve forms an effective seal with the hole being drilled where the passage of air in an upward direction past the transmission sleeve is restricted. It will be obvious to a person skilled in the art that some form of clearance between the transmission sleeve and the hole of the wall is required. However, the clearance will vary depending on ground conditions. It is normal practice to maintain a clearance between the gauge diameter of the drill bit and the transmission sleeve between one to three millimetres. However, other clearances, either larger or smaller, may still be suitable.

SUMMARY OF THE INVENTION

One aspect of this invention is an improved transmission sleeve for a reverse circulation down hole hammer activated by fluid under pressure, said hammer including an outer hammer casing, drill bit retaining means, and a drill bit retained in said retaining means and extending forwardly therefrom, said transmission sleeve comprising:

- a transmission sleeve retaining means to retain said transmission sleeve to said hammer,
- a flange to direct exhaust fluid from said hammer extending from said transmission sleeve retaining means towards the cutting face of said drill bit so that the exhaust fluid is directed towards said cutting face, and
- a chamber that extends circumferentially around said drill bit into which the exhaust fluid flows prior to discharge from the end of said flange.

Preferably, the flange has an outer diameter substantially the same as the gauge diameter of the drill bit to form a seal with the hole being drilled in accordance with the above description of what comprises a seal. Preferably, the camber is intermediate the ends of the flange.

Preferably, the flange is located proximate at the end of the down hole hammer and is preferably spaced as dose as practically possible to the cutting face of the drill bit. A drill bit having a short distance between the cutting face and the end of the flange comprises a further discrete inventive aspect.

Preferably, the flange comprises a generally cylindrical tube machined or produced from a single piece of material. However, the flange may comprise two or more elements such as would be the case if the transmission sleeve were assembled from an inner and outer component. In addition, either the internal or external surface of the transmission sleeve may be coated with materials that improve the surface properties such as hard facing material or other surface treatments that improve the durability or workability of the transmission sleeve.

The transmission sleeve retaining means may include a number of means of securing the transmission sleeve to the hammer. The methods of securing the transmission sleeve to the hammer as set out in Australian Patent No. 638571 are included herein by reference. These include the transmission sleeve being an extension of the drive sub or hammer casing in addition to the preferred arrangement comprising a body that allows securing of the transmission sleeve to the hammer. In general, any arrangement which enables the flange to be secured with respect to the hammer and that allows it to extend towards the drill bit cutting face would be considered within the meaning of "Transmission Sleeve Retaining Means".

The chamber preferably comprises a circumferentially continuous void or plenum from which air flows as it is released from the transmission sleeve. The chamber may be formed in either the head of the drill bit, within the internal surface of the flange or a combination of both.

In a preferred form, the chamber may comprise a manifold where operating fluid, which is directed to the chamber via a plurality of individual fluid channels, exits the chamber also from a plurality of channels. These channels may be formed in either the drill bit in combination with a drill bit retaining means such as a drive sub including channels formed in one or the other only, and channels formed in the portion covered by the transmission sleeve in the drill bit by itself, on the internal surface of the transmission sleeve by itself or in combinations of channels in both the drill bit and internal surface of the transmission sleeve.

The use of the chamber allows a smaller number of inlet channels to feed air into the chamber and for a greater number of channels to direct air from the end of the flange Also, the chamber may act to ensure that exhaust fluid is more evenly distributed around the periphery of the flange. This would include ensuring that exhaust fluid does not only or preferentially exhaust from one segment of the flange and would also include the possibility of providing a substantially continuous curtain of air to exit from the end of the flange.

Preferably, the number of fluid channels entering the chamber equal the number of fluid channels exiting the chamber. These channels are evenly spaced around the periphery of the drill bit. Alternatively, the drill bit may have no channels exiting the chamber so that a continuous curtain fluid is directed around the periphery of the drill bit head.

Another aspect of the invention is a transmission sleeve for a reverse circulation down hole hammer activated by fluid under pressure, said hammer including an outer hammer casing, a drill bit retaining means, and a drill bit retained in the retaining means that extends forwardly therefrom, said transmission sleeve comprising:

a transmission sleeve retaining means to retain said transmission sleeve to said hammer, a flange to direct exhaust air extending from said transmission sleeve retaining means towards the cutting face of said drill bit, and at least five or more circumferentially spaced channels that extend at least from the cutting face of the drill bit to the flange to thereby direct exhaust fluid from the end of the flange towards the cutting face of the drill bit.

In known prior art hammers, it is accepted procedure to reduce the number of channels on the shank so that a lesser number of channels extend across the outer portion of the drill bit head. For example, it is common for eight spline channels to reduce to four only from the end of the shank to the cutting face. Accordingly, another aspect of this invention is to provide a conduit having a continuous un-branching path where the spline conduit is aligned with conduits that continue to the cutting face or themselves continue to the cutting face.

It has been found that a more even distribution of air around the periphery of the drill bit has a significant improvement in the overall performance of the hammer. Preferably, the number of channels comprises eight but dearly more channels than are currently used in the industry will provide a significant improvement.

Another aspect of the invention is a drill bit for use in a reverse circulation down hole hammer where the hammer is activated by fluid under pressure, said hammer including an outer hammer casing and a drill bit retaining means for retaining said drill bit, where the invention is characterised by the drill bit having a concave peripheral groove formed in the drill bit at a position spaced from the cutting face of the drill bit.

In relation to a conventional drill bit which comprises a shank portion and a head portion, it has been found that a bit having a peripheral concave groove formed in the head of the piston significantly improves the overall performance of the hammer. The peripheral groove improves the mass distribution of the bit and efficiency of energy transfer through the bit. It also provides a convenient means of balancing the weight of the drill bit by comparison to the hammer piston.

In addition, in respect of this aspect of the invention, the hammer may be used without a shroud where the diameter of the head of the drill bit is similar to the diameter of the hole being drilled. In this case, the longitudinal channels in the head of the drill bit together with the concave peripheral groove form a seal through the side walls of the head of the drill bit being in contact with the wall of the hole being drilled. Provided that an adequate seal is achieved on the hammer above the point at which the exhaust air is released, then the exhaust air will be directed towards the cutting face of the drill bit through the conduits formed by the longitudinal channels and the concave peripheral groove. The concave peripheral groove will allow the distribution of air to the cutting face to be more even around the circumference of the drill bit.

In order to fully understand each aspect of the invention, a preferred embodiment will now be described. However it should be realised that the invention is not confined or restricted to the combinations of elements comprising any one of the embodiments. Modifications and variations that would be apparent to a skilled addressee are deemed to be within the scope of the present aspects of the above-mentioned inventions.

BRIEF DESCRIPTION OF THE DRAWINGS

This embodiment is illustrated in the accompanying representations in which.

DETAILED DESCRIPTION

Figure 5:
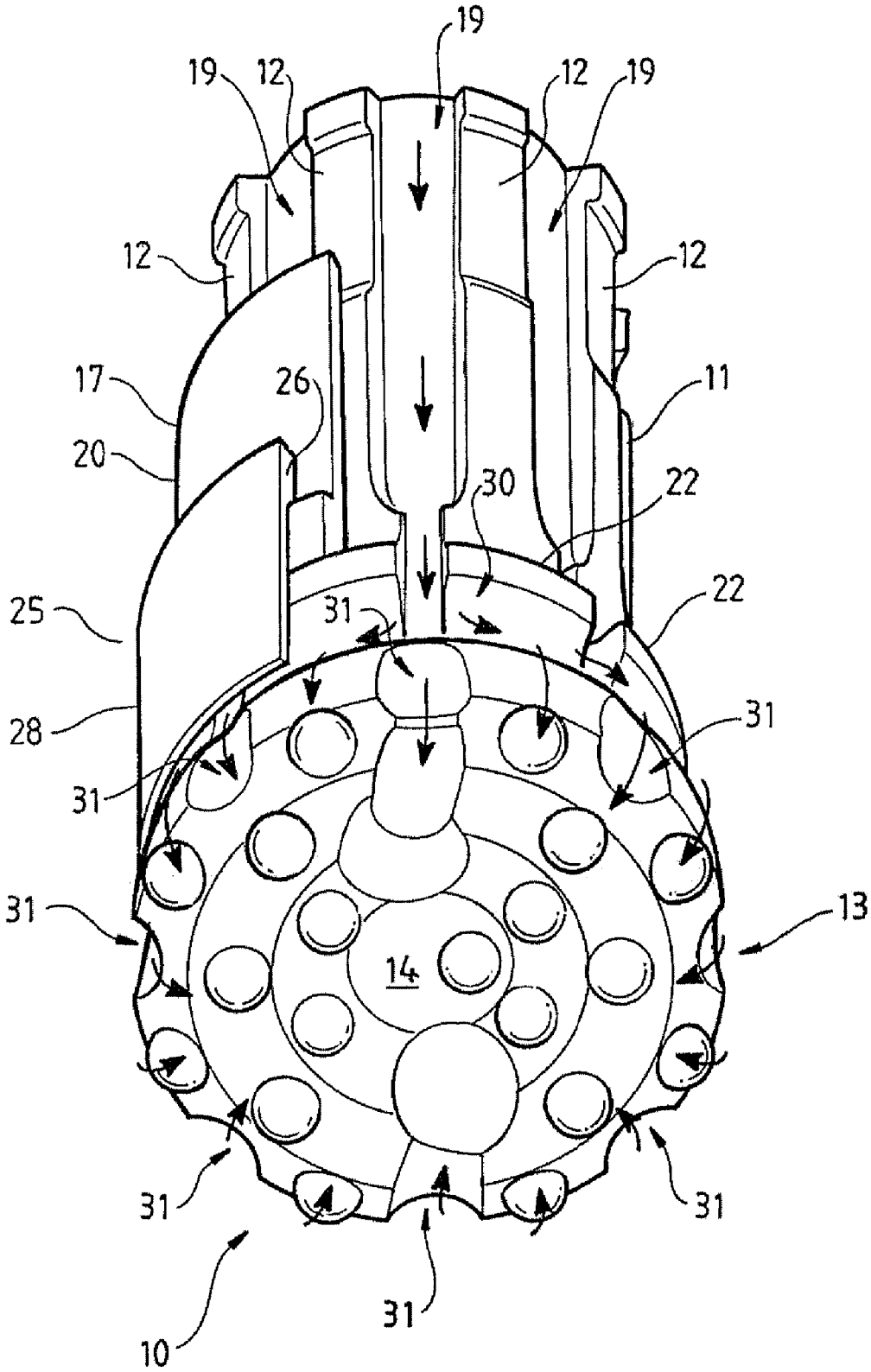
FIG. 5 show a part cutaway perspective view of the assembly shown in FIG. 1.

The embodiment of FIGS. 1 to 5 show a drill bit 10 which comprises a shank 11 that has splines 12 along part of a length of the shank 11. The drill bit also includes a head 13 and a cutting face 14. Note that the cutting face 14 shown in FIG. 1 does not include the tungsten carbide buttons which are normally spaced around the periphery of the cutting face 14 and across the remainder of the face in a spaced manner as shown in FIG. 5.

Figure 1:
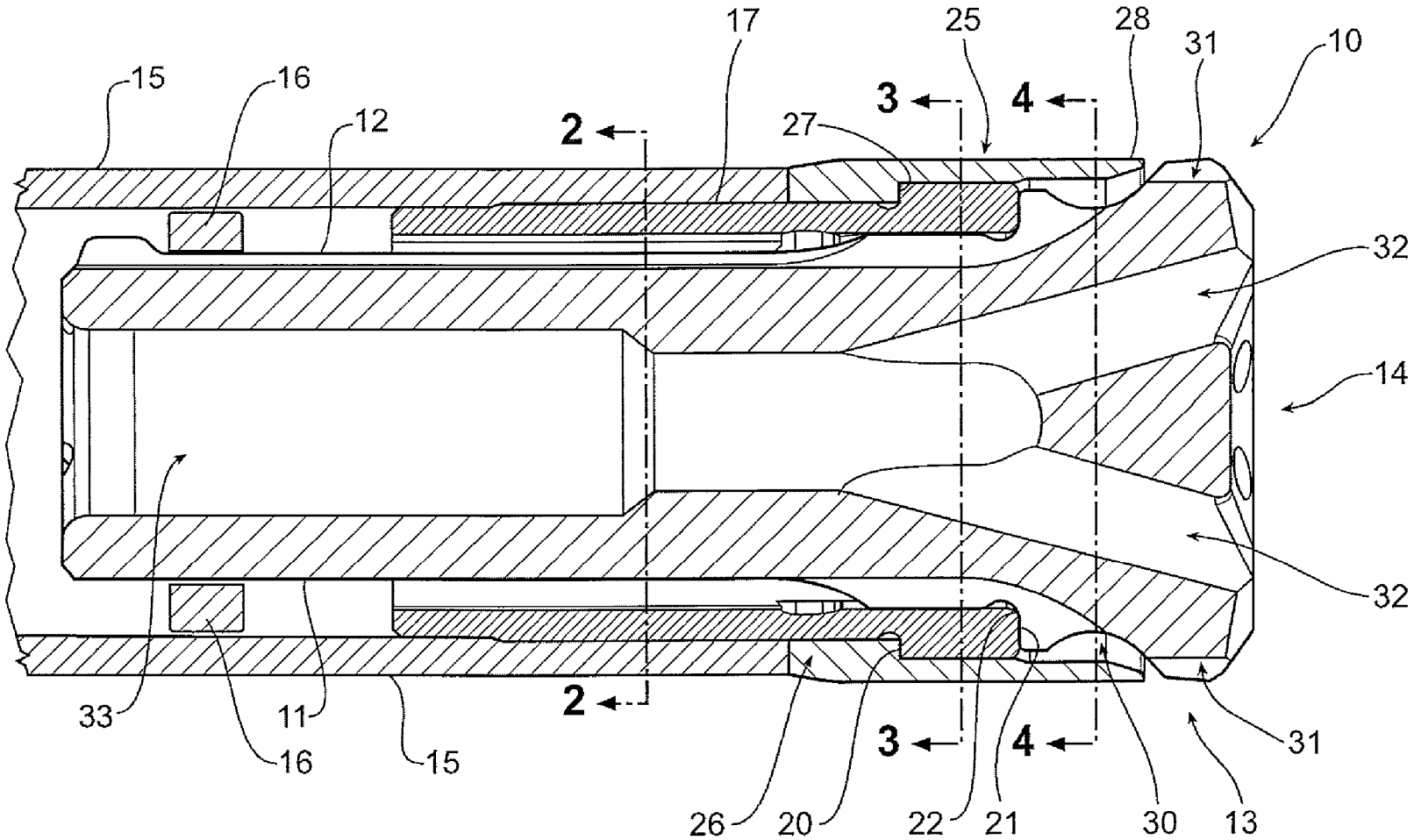
FIG. 1 shows a longitudinal cross-section view of a drill bit transmission sleeve and a drill bit retaining means.
Figure 2:
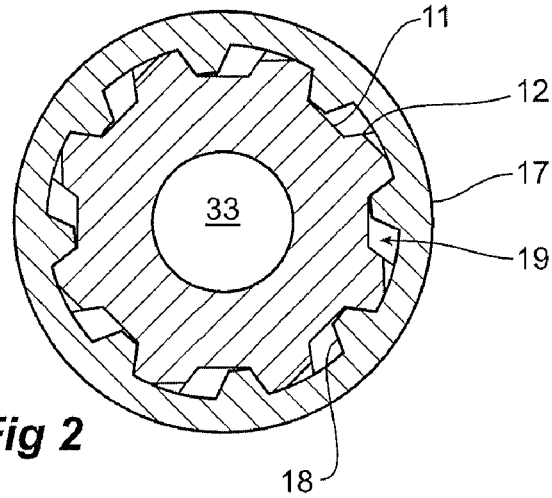
FIGS. 2 to 4 show cross-section views at three positions along the assembly shown in FIG. 1.
Figure 3:
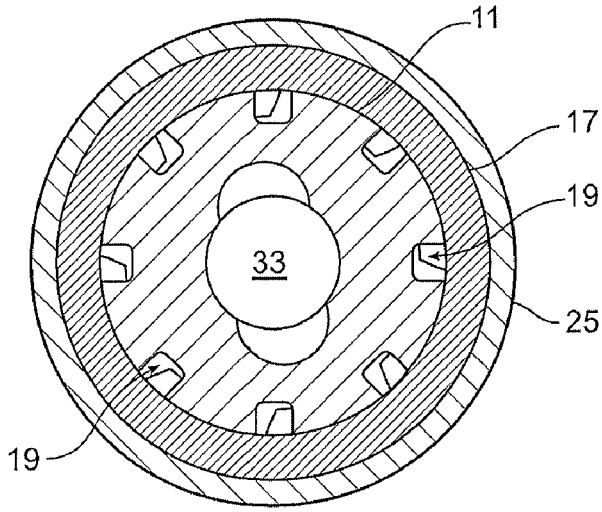
Figure 4:
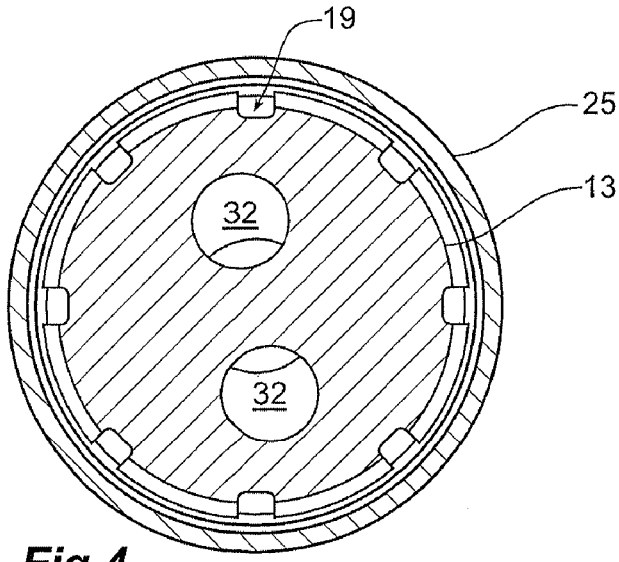

The drill bit retaining means includes a drive sub 17, which has internal splines 18 that engage with the splines 12 on the shank of the drill bit. The drive sub 17 threadably engages to the end of an outer hammer casing 15 and the chili bit retaining means includes conventional split D-rings 16 that locate on the shank 11 as seen in FIG. 1 as well as the drive sub 17. As seen in section, A-A of FIG. 2 the space between the adjacent splines 12 on the shank 11 is wider than the spline 18 that locates therebetween. The hammer assembly is rotated by the drill string and the drive sub is normally fixed with respect to the hammer. This causes the splines 18 of the drive sub 17 to position themselves as shown in FIG. 2 to thereby form channels 19 through which exhaust air flows when it exhausts from the piston chamber of the hammer.

The forward end of the drive sub 17 has an enlarged diameter portion which forms a shoulder 20. The end of the drive sub 21 abuts against a shoulder 22 formed between the shank 11 and head 13 of the drill bit 10. In normal operation of the hammer, the end of the drive sub 21 may be spaced slightly away from the shoulder 22 of the drill bit 10.

Figure 6:
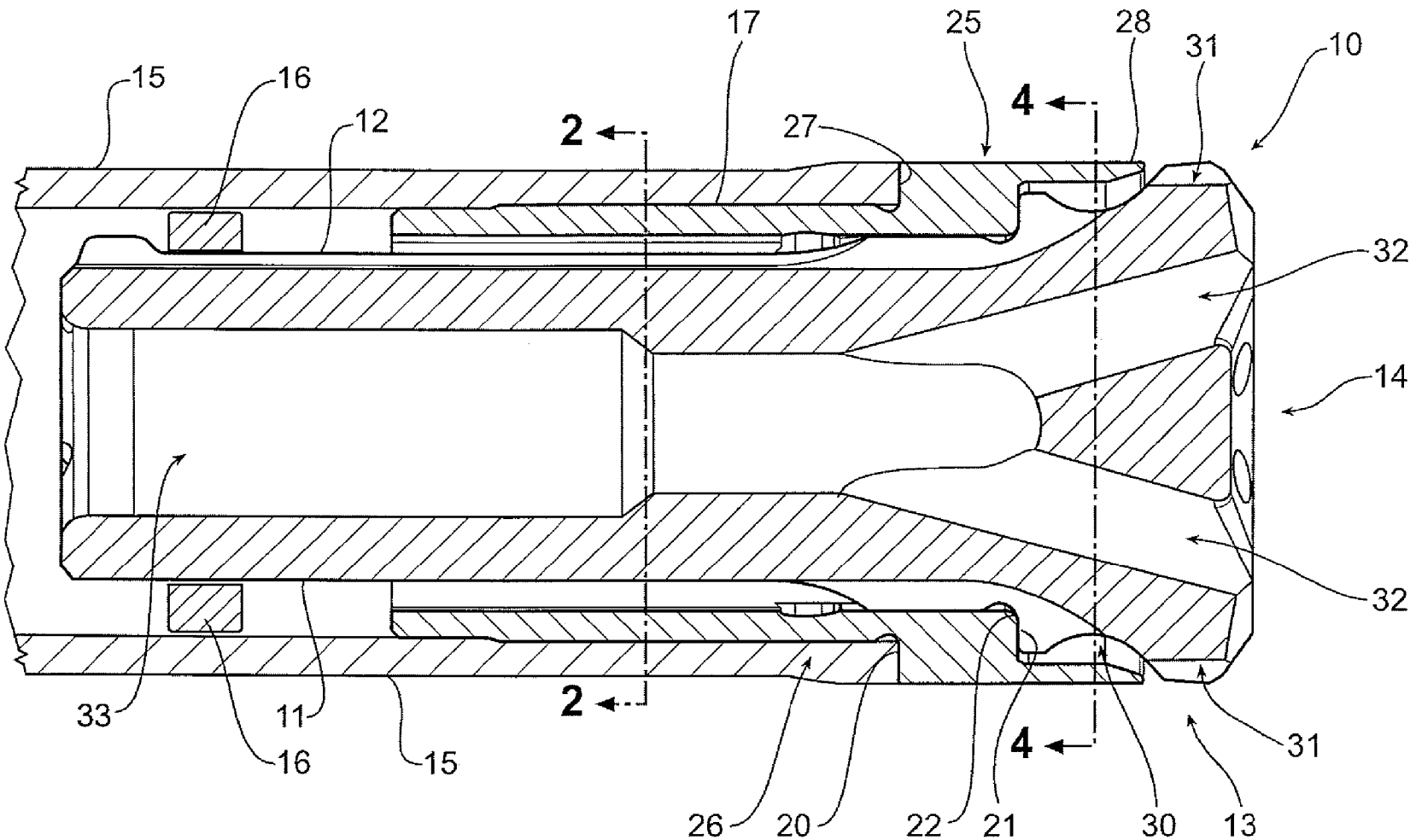
FIG. 6 shows a longitudinal cross-section of a drill bit, transmission sleeve and drive sub where the transmission means is integrally formed as part of the drive sub.
Figure 7:
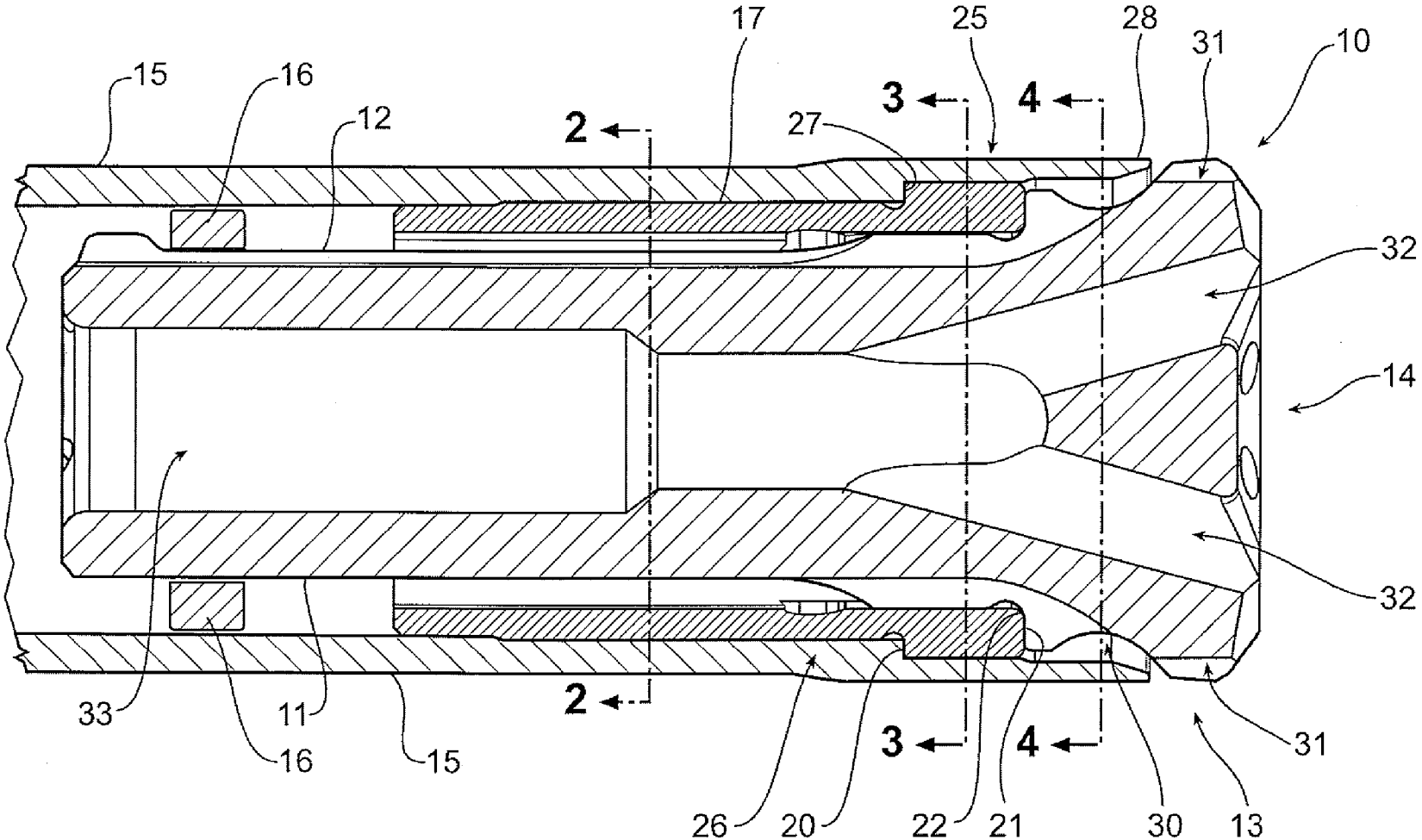
FIG. 7 shows a longitudinal cross-section of a drill bit transmission sleeve, hammer casing and drive sub where the transmission sleeve is integrally formed as part of the hammer casing.

The transmission sleeve 25 comprises a transmission sleeve retaining means which in this embodiment is a body 26 formed by an upper portion of the transmission sleeve having a smaller internal diameter thereby forming shoulder 27. The internal diameter of the body 26 matches the external diameter of the drive sub 17 so that the transmission sleeve 25 is located onto the drive sub 17 from its upper end and the shoulder 27 of the transmission sleeve 25 abuts against the shoulder 20 of the drive sub 17. A flange 28 extends from the body 26 in this embodiment. The flange extends past the end of the drive sub 21 although the invention may also comprise an extension of the end of the drive sub 21 (FIG. 6) so that the drive sub 21 is coterminous with the end of the flange 28. In this example, the internal surface of the drive sub acts to direct the air in the same way as the flange 28. A further alternative is shown in FIG. 7 where the transmission sleeve is an extension of the outer hammer casing 15.

A chamber 30 is located between the shoulder 22 and the cutting face 14 of the drill bit 10. In this embodiment, the chamber 30 comprises an arcuate groove in cross-section forming a concave groove that extends around the periphery of the drill bit head 13.

In this embodiment, the channels 19 that are formed between the splines 12 extend along the shank 11 of the drill bit 10 past the end of the drive sub 21 and open up into the chamber 30. These channels 19 run out into the chamber 30. The flange 28 in this embodiment extends so that it covers most of the chamber 30, however, the invention will also include the flange extending past the chamber 30 or terminating short of the lower edge of the chamber 30. In each case, the flange 28 may comprise a number of components, be coated internally and/or externally or the drive sub may be extended along the internal surface of the flange 28 so that it terminates at the end of the flange 28.

Further longitudinal channels 31 extend from the chamber 30 to the cutting face 14. In this embodiment, the number of longitudinal channels 31 equal and are aligned with channels 19.

In operation of the embodiment shown in the drawings, and as can be most clearly seen in the second page of the drawings, exhaust air from the hammer is directed to the end of the drive sub 21 along the channels 19. These channels 19 open into a chamber 30 which are fully or partially covered by the flange 28. Longitudinal channels 31 are formed in the head 13 of the drill bit 10 and provide a path for exhaust air to the cutting face 14 when it exits the chamber 30 and flows past the end of the flange 28. The chamber 30 makes it possible for air pressure to be equalised around the periphery of the drill bit 10 and allows for some air to flow from the end of the flange 28 between the longitudinal channels 31 to provide a curtain of air flow from the flange 28.

It may be possible that the drill bit head 13 could be formed without the channels 31. In this case, it is more likely that the air would be more evenly distributed so that a peripheral curtain of air would exit from the end of the flange 28. However, even with longitudinal channels 31, air is more likely to flow toward the cutting face 14 so that some air will flow over the drill bit head 13 between the longitudinal channels 31.

In this embodiment, the outer diameter of the transmission sleeve 25 is of the order of 3 mm (radius) smaller than the radius of the gauge row of carbide buttons of the drill bit 10. In a great range of operating circumstances, this is sufficient to form a seal between the transmission sleeve 25 and the hole of the wall being drilled to prevent significant blow back of air past the transmission sleeve 25. In certain circumstances, a peripheral gap as small as 1 mm can be used although it could vary to be smaller than 1 mm or greater than 3 mm, depending on the drilling conditions.

As with the earlier Australian Patent No. 638571, the transmission sleeve is preferably sacrificial so that it wears sympathetically with the wear of the drill bit. In normal circumstances, the gauge diameter of the drill bit 10 will reduce slightly as the hammer is being operated. The transmission sleeve has the ability to wear in sympathy with the drill bit in order to maintain an effective seal with the wall of the hole being drilled.

The exhaust air from the hammer is able to flow from the end of the flange 28 across the cutting face 14 and the air and cuttings are delivered through the hammer via conduits 32 and 33.

This embodiment uses eight radially spaced channels 19 and 31. Until now, it has been common in the industry to use a lesser number of circumferentially spaced channels 31. It has been found that increasing the number of longitudinal channels 31 significantly improves the performance of the hammer. This results from more even distribution of air around the periphery of the drill bit head 13. Accordingly, another aspect of the invention is the drill bit shown in the accompanying drawing without the chamber 30 but with five or more radially spaced channels 19 and 31. Preferably, at least eight channels 19, 31 are used.

Further, it has been found that a drill bit with a concave circumferential groove provides a significant improvement in energy transfer to the cutting face 14. Accordingly, another aspect of the invention would be the drill bit shown in the accompanying drawings but with or without the transmission sleeve 25. Relieving the head of the drill bit 13 with a concave peripheral groove improves the mass distribution within the drill as described above to thereby improve the performance of the hammer.

The invention claimed is:

1. A transmission sleeve for a reverse circulation down hole hammer activated by fluid under pressure, said hammer including an outer hammer casing, drill bit retaining means, and a drill bit retained in said retaining means and having a drill bit head and cutting face extending forwardly therefrom, said transmission sleeve comprising: a transmission sleeve retaining means to retain said transmission sleeve to said hammer, a flange having a lower end to direct exhaust fluid from said hammer extending from said transmission to sleeve retaining means towards the cutting face of said drill bit so that the exhaust fluid is directed towards said cutting face, and a chamber that extends circumferentially around said drill bit head into which the exhaust fluid flows prior to discharge from the lower end of said flange.

2. A transmission sleeve according to claim 1 wherein said chamber is formed in the drill bit head of said drill bit.

3. A transmission sleeve according to claim 2 wherein the said chamber is a concave groove that extends around the drill bit head of said drill bit.

4. A transmission sleeve according to claim 1 wherein the lower end of said flange is spaced as close as possible to the cutting face of said drill bit.

5. A transmission sleeve according to claim 1 wherein said drill bit has a shank and a plurality of circumferentially spaced longitudinal channels in said drill bit head and wherein air flows into said chamber from a plurality of channels formed between the shank of said drill bit and said drill bit retaining means, and exits said chamber through said plurality of longitudinal channels as well as between said longitudinal channels.

6. A transmission sleeve according to claim 1 wherein the number of channels entering said chamber equals the number of longitudinal channels exiting said chamber.

7. A transmission sleeve according to claim 6 wherein the number of longitudinal channels exiting said chamber is at least five or more.

8. A transmission sleeve according to claim 7 wherein each one of said channels entering said chamber aligns with a longitudinal channel exiting said chamber.

9. A transmission sleeve for a reverse circulation down hole hammer activated by fluid under pressure, said hammer including an outer hammer casing, drive sub and a drill bit retained in said drive sub and having a drill bit head and cutting face extending forwardly therefrom, said transmission sleeve comprising: a flange having a first end integrally formed with said drive sub extending from said drive sub towards the cutting face of said drill bit so that the exhaust fluid is directed said flange directs exhaust fluid towards said cutting face, and a chamber that extends circumferentially around said drill bit head into which the exhaust fluid flows prior to discharge from the lower end of said flange.

10. A transmission sleeve for a reverse circulation down hole hammer activated by fluid under pressure, said hammer including an outer hammer casing, drill bit retaining means, and a drill bit retained in said retaining means and having a drill bit head and cutting face extending forwardly therefrom, said transmission sleeve comprising: a flange having a first end integrally formed with said outer hammer casing extending from said outer hammer casing towards the cutting face of said drill bit so that said flange directs exhaust fluid towards said cutting face, and a chamber that extends circumferentially around said drill bit head into which the exhaust fluid flows prior to discharge from the lower end of said flange.

* * * * *